US009498012B1

(12) United States Patent
Handie

(10) Patent No.: US 9,498,012 B1
(45) Date of Patent: Nov. 22, 2016

(54) DEPLOYABLE UMBRELLA HOOD GARMENT

(71) Applicant: Andronica Handie, Tulsa, OK (US)

(72) Inventor: Andronica Handie, Tulsa, OK (US)

( * ) Notice: Subject to any disclaimer, the term of this patent is extended or adjusted under 35 U.S.C. 154(b) by 0 days.

(21) Appl. No.: 14/698,161

(22) Filed: Apr. 28, 2015

Related U.S. Application Data

(60) Provisional application No. 61/987,672, filed on May 2, 2014.

(51) Int. Cl.

| | |
|---|---|
| ***A41D 15/04*** | (2006.01) |
| ***A41D 15/00*** | (2006.01) |
| ***A42B 1/20*** | (2006.01) |
| ***A41D 1/00*** | (2006.01) |
| ***A42B 1/00*** | (2006.01) |
| ***A42B 1/18*** | (2006.01) |

(52) U.S. Cl.
CPC ..... *A42B 1/201* (2013.01); *A41D 1/002* (2013.01); *A41D 15/00* (2013.01); *A42B 1/002* (2013.01); *A42B 1/006* (2013.01); *A42B 1/008* (2013.01); *A42B 1/18* (2013.01)

(58) Field of Classification Search
CPC ..... A45B 11/02; A45B 11/00; A45B 23/00; A45B 2023/0006; A45B 25/143; A45B 2023/0093; A45B 19/02; A45B 19/04; A45B 25/00; A45B 19/10; A45B 2200/1009; A45B 25/16; A45B 25/165; A45B 11/04; A45B 19/00; A45B 25/14; A45F 4/02; A45C 13/40; A42B 3/322; A42B 1/201; A42B 1/048; H05B 2203/014; H05B 3/342; H05B 2203/003; A41D 15/04; A41D 2200/20; A41D 13/0051; A41D 13/018; A41D 13/0007; A41D 2400/48
See application file for complete search history.

(56) References Cited

U.S. PATENT DOCUMENTS 1,398,165 A * 11/1921 Whiteside ..... A41D 3/08 2/171
1,416,481 A * 5/1922 Longoria ..... H05B 3/342 139/425 R
1,530,216 A * 3/1925 Steer ..... H05B 3/342 139/425 R
1,803,538 A * 5/1931 Pistole ..... A45B 11/02 135/123
2,140,647 A * 12/1938 Myers ..... A45B 11/04 135/19.5
3,026,525 A * 3/1962 Gyorfy ..... A42B 3/225 2/202
3,514,785 A * 6/1970 Smith ..... A62B 18/04 128/202.11
3,708,803 A * 1/1973 Teaff ..... A42B 1/201 2/171.01
3,856,030 A * 12/1974 Sato ..... A45B 25/143 135/22
3,951,160 A * 4/1976 Nitu ..... A45B 11/02 135/20.2
4,112,957 A * 9/1978 Biven ..... A45B 11/00 135/87
4,179,053 A * 12/1979 Figura ..... A45F 3/08 135/120.3
4,188,965 A * 2/1980 Morman ..... A45B 11/02 135/15.1
4,291,417 A * 9/1981 Pagano ..... A42B 1/201 2/202
4,404,460 A * 9/1983 Kerr ..... A41D 13/0051 2/69
4,456,023 A * 6/1984 Fujihashi ..... A45B 19/00 135/25.41
4,572,226 A * 2/1986 Williams ..... A45B 25/14 135/20.3
4,607,397 A * 8/1986 Laxo ..... A42B 3/322 2/410

(Continued)

*Primary Examiner* — Bobby Muromoto, Jr.

(74) *Attorney, Agent, or Firm* — Williams Intellectual Property; Benjamin F. Williams

(57) ABSTRACT

A deployable umbrella hood garment that includes a waterproof umbrella hood moveable between a folded position, furled within a pack member dorsally dispositional upon said garment, and a deployed position, extended to encapsulate the head of a user and securable in said deployed position by means of a support member disposed interior to the hood, whereby automated and expedient deployment of said umbrella hood is effective between said stowed and deployed positions to prevent contact of rainfall with a user's head.

13 Claims, 4 Drawing Sheets

(56) References Cited

U.S. PATENT DOCUMENTS 4,792,040 A * 12/1988 Wagstaff, III ..... A41D 3/06 150/167
4,962,779 A * 10/1990 Meng ..... A45B 3/00 135/16
4,978,110 A * 12/1990 Lin ..... A45B 3/04 135/33.4
5,008,517 A * 4/1991 Brekkestran ..... H05B 3/342 219/211
5,032,705 A * 7/1991 Batcheller ..... A41D 13/0051 219/211
5,116,288 A * 5/1992 Kondo ..... A45B 23/00 135/135
5,213,122 A * 5/1993 Grady, II ..... A45B 25/165 135/20.3
5,388,603 A * 2/1995 Bauer ..... A45B 3/00 135/16
5,449,012 A * 9/1995 Friedman ..... A45B 25/18 135/16
5,604,935 A * 2/1997 Nezer ..... A42B 3/322 2/410
5,620,034 A * 4/1997 Flis ..... A63B 55/406 150/159
5,628,071 A * 5/1997 Nezer ..... A42B 3/322 2/410
5,784,719 A * 7/1998 Robinson ..... A41D 3/00 2/93
5,887,771 A * 3/1999 Perry ..... A45B 11/02 224/190
5,896,590 A * 4/1999 Fleisch ..... A42B 3/322 2/410
5,909,802 A * 6/1999 Puco ..... A45F 3/04 2/102
6,024,264 A * 2/2000 Java ..... A45B 3/00 135/16
6,024,464 A * 2/2000 De Vera ..... A45B 3/04 224/190
6,053,385 A * 4/2000 Ward ..... A45B 11/00 224/153
6,247,482 B1 * 6/2001 Muis ..... A45B 11/02 135/16
6,308,722 B1 * 10/2001 Christie ..... A45B 11/00 135/16
6,866,173 B2 * 3/2005 Haber ..... A45F 3/04 224/160
6,925,966 B1 * 8/2005 Wexler ..... A01K 13/006 119/814
7,069,939 B1 * 7/2006 Conde ..... A45B 25/00 135/16
7,120,955 B2 * 10/2006 Wang ..... A45B 19/02 417/239
D590,145 S * 4/2009 Kaufman ..... D3/5
7,641,085 B2 * 1/2010 Nickels ..... A45B 11/02 224/188
D653,846 S * 2/2012 Goebel ..... D3/12
8,132,582 B2 * 3/2012 Goebel ..... A45B 11/02 135/16
8,387,641 B1 * 3/2013 Ilan ..... A61G 5/10 135/34.2
8,402,568 B2 * 3/2013 Alstin ..... A41D 13/018 2/413
8,556,141 B1 * 10/2013 Ferraiolo ..... A45B 17/00 224/186
8,678,019 B2 * 3/2014 Christie ..... A45F 4/02 135/16
8,733,378 B2 * 5/2014 Tayebi ..... A45B 11/02 135/16
8,944,300 B1 * 2/2015 Kaufman ..... A45B 11/02 135/16
9,057,206 B2 * 6/2015 Lin ..... E04H 15/28
D756,612 S * 5/2016 Broderick ..... D2/880
2004/0164066 A1 * 8/2004 Ford ..... A41D 13/0051 219/211
2005/0028451 A1 * 2/2005 Knoepp ..... A45B 25/20 52/3
2005/0028851 A1 * 2/2005 Knoepp ..... A45B 25/20 135/15.1
2005/0275257 A1 * 12/2005 McGregor ..... B60N 2/2842 297/219.12
2008/0012258 A1 * 1/2008 Townsend ..... A61G 10/02 280/47.38
2008/0054032 A1 * 3/2008 Jones ..... A45F 4/06 224/156
2008/0078790 A1 * 4/2008 Bolling ..... A45B 11/00 224/190
2008/0116236 A1 * 5/2008 Nickels ..... A45F 3/08 224/190
2008/0209612 A1 * 9/2008 Summers ..... A41D 15/04 2/84
2008/0264808 A1 * 10/2008 Gostt ..... A45F 4/02 206/216
2008/0282453 A1 * 11/2008 Alstin ..... A41D 13/018 2/413
2008/0283108 A1 * 11/2008 Torres ..... E04H 15/38 135/149
2009/0194570 A1 * 8/2009 Vadher ..... A45B 11/02 224/576
2009/0272773 A1 * 11/2009 Andrade ..... A41D 13/0012 224/153
2010/0059558 A1 * 3/2010 Robinson ..... A41D 3/08 224/155
2010/0078457 A1 * 4/2010 Pitchford ..... A42B 1/048 224/576
2010/0243689 A1 * 9/2010 Fozooni ..... A45B 11/02 224/190
2010/0282803 A1 * 11/2010 Simmons ..... A41D 13/0007 224/576
2010/0313922 A1 * 12/2010 Raider ..... A45B 11/02 135/16
2011/0035877 A1 * 2/2011 Biddle ..... A47C 29/006 5/93.1
2011/0147427 A1 * 6/2011 Weaver ..... A45B 11/00 224/576
2012/0037195 A1 * 2/2012 Goebel ..... A45B 11/02 135/16
2012/0312850 A1 * 12/2012 Killion ..... A45F 4/12 224/576
2013/0092715 A1 * 4/2013 Tayebi ..... A45B 11/02 224/576
2013/0098410 A1 * 4/2013 Prasannakumar ..... A45B 11/00 135/16
2013/0213445 A1 * 8/2013 Christie ..... A45F 4/02 135/16
2013/0233362 A1 * 9/2013 Miller-Klerer ..... A45B 23/00 135/16
2013/0298952 A1 * 11/2013 Williams ..... A45B 11/02 135/22
2013/0313295 A1 * 11/2013 Jacquette ..... A45B 11/02 224/190
2015/0144165 A1 * 5/2015 Rao ..... A45B 3/00 135/16

* cited by examiner

DEPLOYABLE UMBRELLA HOOD GARMENT

CROSS-REFERENCE TO RELATED APPLICATIONS

This nonprovisional application claims the benefit of provisional application No. 61/987,672 filed on May 2, 2014

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of umbrellas and hooded garments are known in the prior art. However, what is needed is a deployable umbrella hood garment that includes a waterproof umbrella hood moveable between a folded position, furled within a pack member dorsally dispositional upon said garment, and a deployed position, extended to is encapsulate the head and shoulders of a user and thereat securable in said deployed position by means of a support member disposed interior to the hood, whereby automated deployment of said umbrella hood is effective between said folded and deployed positions to prevent contact of rainfall with a user's head.

FIELD OF THE INVENTION

The present invention relates to a deployable umbrella hood garment, and more particularly, to a deployable umbrella hood garment that includes a waterproof umbrella hood moveable between a folded position, furled within a pack member dorsally dispositional upon said garment, and a deployed position, extended to encapsulate the head and shoulders of a user and thereat secured in said deployed position by means of a support member disposed interior to the hood, whereby automated and expedient deployment of said umbrella hood is effective between said folded and deployed positions to prevent contact of rainfall with a user's head.

SUMMARY OF THE INVENTION

The general purpose of the deployable umbrella hood garment, described subsequently in greater detail, is to provide a deployable umbrella hood garment which has many novel features that result in a deployable umbrella hood garment which is not anticipated, rendered obvious, suggested, or even implied by prior art, either alone or in combination thereof.

The present deployable umbrella hood garment has been devised to enable articulation and support of a deployable waterproof umbrella hood from a pack member dorsally dispositional upon a garment, whereby said waterproof umbrella hood is moveable from a folded position, stowed interior to said pack member, and a deployed position, supported encapsulating a user's head and shoulders to prevent contact with rainfall.

The term "garment", as used herein throughout, is taken to include all wearable devices, including, for example, clothing and backpacks, and other such devices portable upon the back of a user, whereby disposition of a waterproof umbrella hood for deployment to encapsulate the head and shoulders of a user is enabled.

The present deployable umbrella hood garment, therefore, incudes a pack member dorsally dispositional upon a garment. The pack member is openable at an upper end disposed proximal the nape of the neck of a user wearing the pack member. A waterproof umbrella hood is deployable from the pack member to encapsulate a user's head and shoulders and prevent contact thereof with rainfall.

The waterproof umbrella hood includes a support member disposed interior to said hood. The support member is disposed to enable automated deployment and folding of the hood, and also to support the umbrella hood appropriately when moved to the deployed position.

The support member is inflatable and operable by air pressurized therein by action of a motorized pump member. In this embodiment, the support member includes an inflatable base portion, an inflatable outer frame member disposed to line the opening of the hood, and a plurality of inflatable arcuate frame members disposed between the outer frame member and the base portion, wherein rapid inflation of the support member is operative, and the hood readily deployable, by action of a motorized pump member forcing air to pressurize the support member. Upon depression of a button, or other action effective of opening of the pack member member, the pump member is activated to force air from the ambient surroundings and inflate the support member whereby the hood is expanded an expediently into the deployed position.

Inflation of the support member by action of the pump member is effected sequentially by controlled airflow interior to the support member, said airflow controllable by passage through a plurality of apertures disposed between the base portion and each of the plurality o frame members and the outer frame member, whereby the base portion is inflatable first, then the outer frame member and each of the plurality of arcuate frame members is inflatable in sequence. Thus the hood is deployable from the pack member.

The support member includes at least one spring member disposed interior to at least one of the plurality of frame members. The spring member is tensioned when the support member is inflated. Deflation of the support member, therefore, enables action of the spring member recoil to refold the hood in to the folded position, whereby the hood is automatically stowed to the folded position. Deflation of the support member may be effected by action of the pump member forcing air out from the support member, whereby deflation of the support member is rapidly effected.

Movement between the stowed position and the deployed position may also be effected manually, or by mechanical means such as against the tension of a spring member in action with an articulated frame, or by motorized means, by the action of a motor or a motorized pump member. A ripcord may be included whereby pulling upon the ripcord effects deployment of the waterproof umbrella hood.

In an example embodiment herein disclosed, a garment is provided to which the pack member is selectively attachable, when desired. At least one heating pad is disposed interiorly within the garment wherein electrical energy is radiated as heat interior to the garment through a bostrophedonic coil of wires. Any battery required for operation of the pump member and the at least one heating pad may be situated interior to the pack member.

Thus has been broadly outlined the more important features of the present deployable umbrella hood garment so that the detailed description thereof that follows may be better understood and in order that the present contribution to the art may be better appreciated.

Objects of the present deployable umbrella hood garment, along with various novel features that characterize the invention are particularly pointed out in the claims forming a part of this disclosure. For better understanding of the deployable umbrella hood garment, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
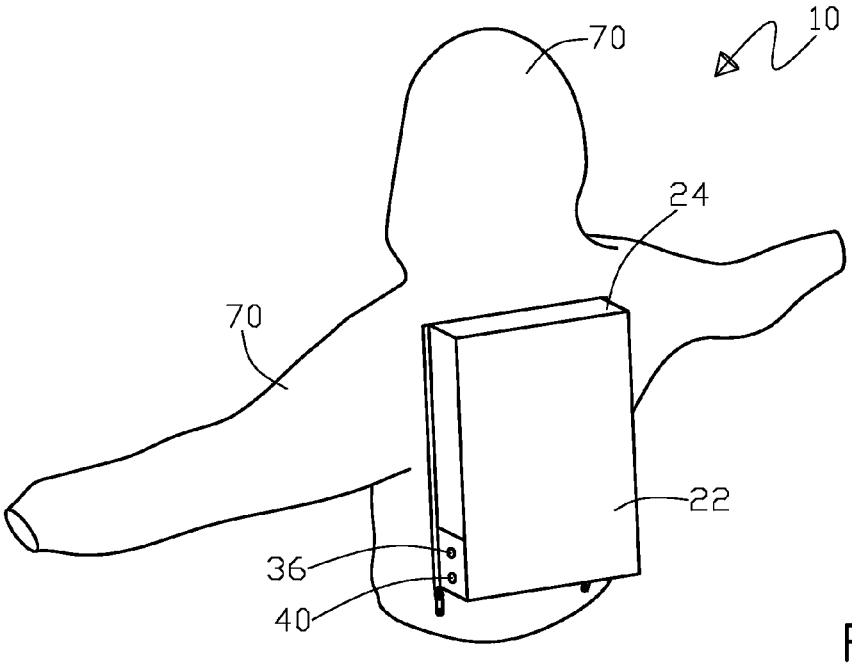
FIG. 1 is an elevated rear view of an example embodiment of a deployable umbrella hood garment.
Figure 2:
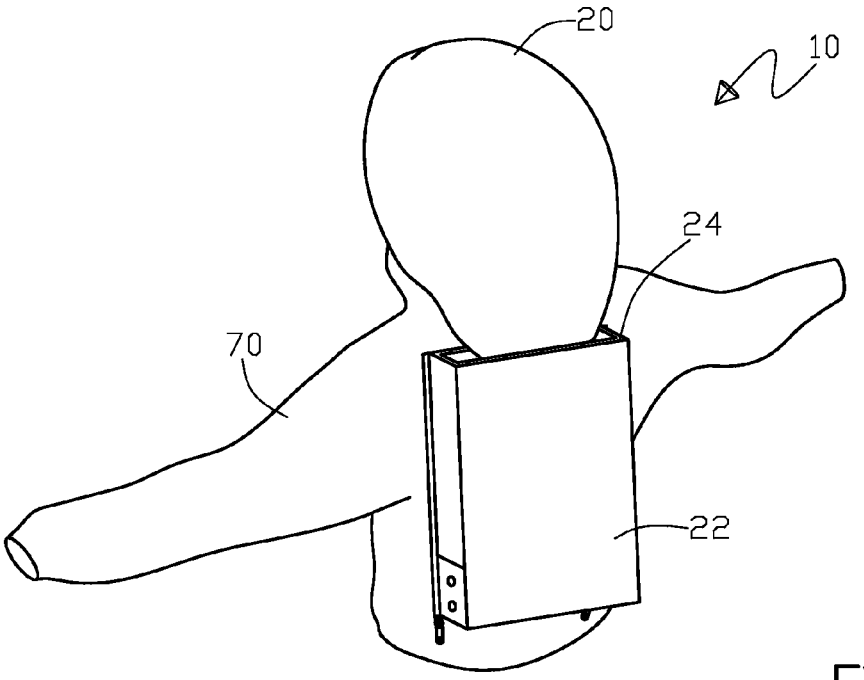
FIG. 2 is an elevated rear view of an example embodiment with a waterproof umbrella hood deployed.
Figure 3:
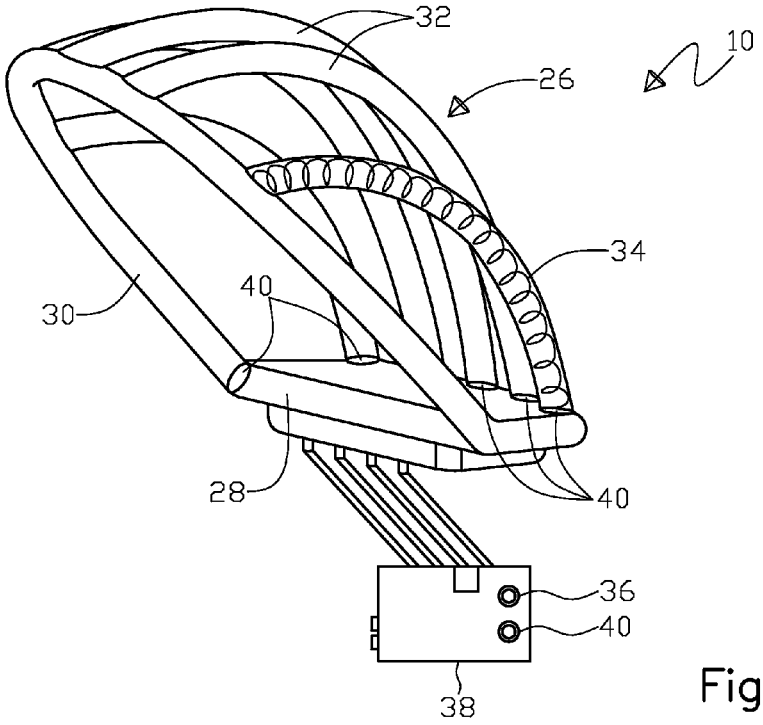
FIG. 3 is an isometric view of an example embodiment of an inflatable support member disposed to support the umbrella hood in the deployed position when inflated by action of a pump member.
Figure 4:
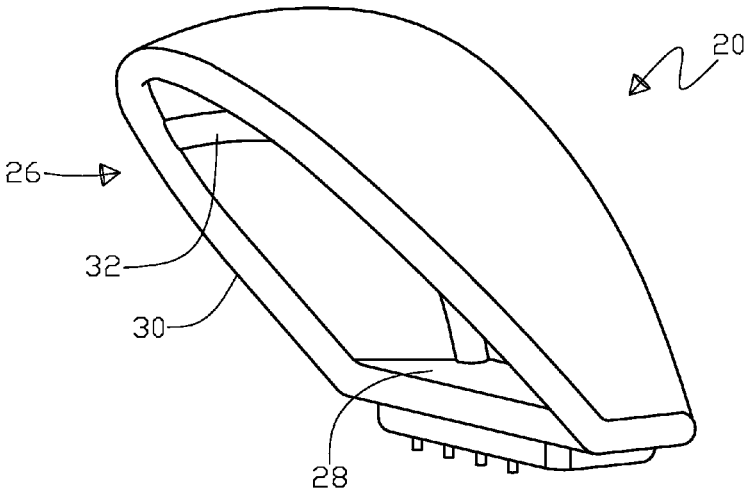
FIG. 4 is an isometric view of an example embodiment of the waterproof umbrella hood.
Figure 5:
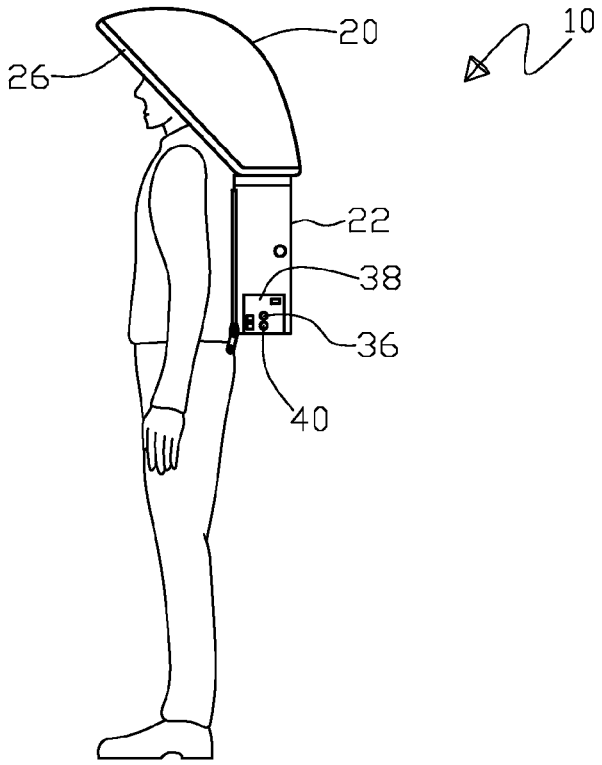
FIG. 5 is a side view of a user wearing an example embodiment of the deployable umbrella hood garment with the umbrella hood deployed.
Figure 6:
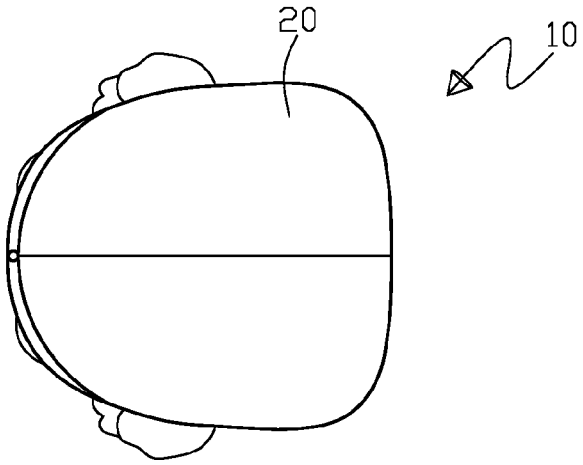
FIG. 6 is top view of a user wearing an example embodiment of the deployable umbrella hood garment with the umbrella hood deployed.
Figure 7:
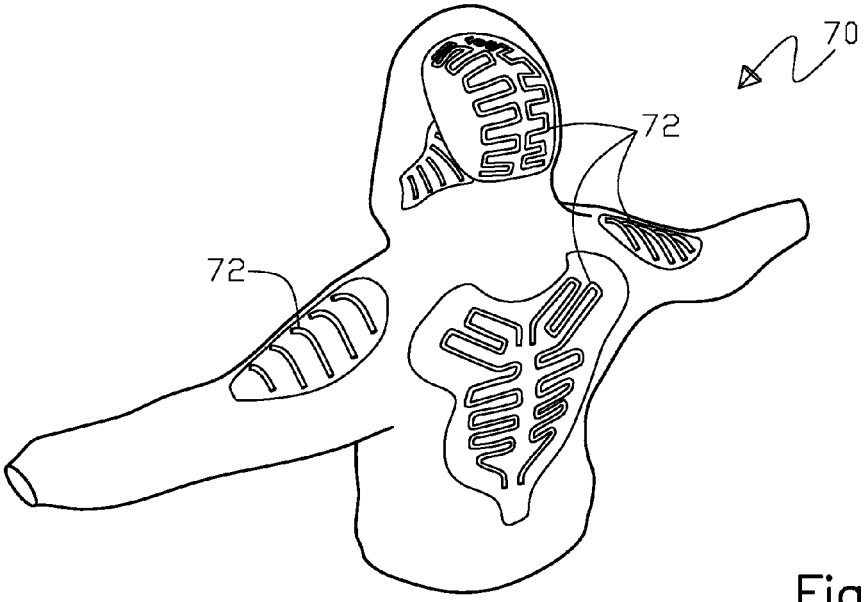
FIG. 7 is an isometric rear view of an example embodiment of a garment having at least one heating pad therein.
Figure 8:
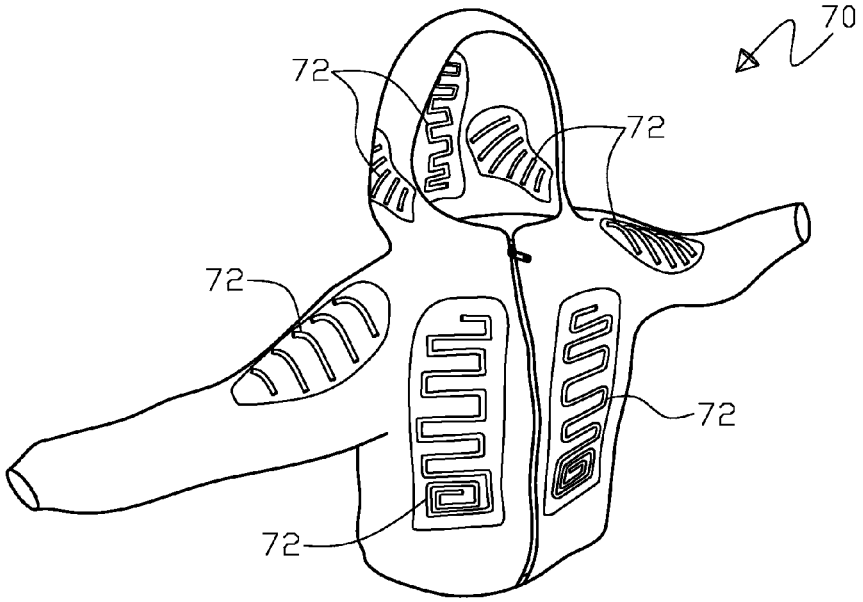
FIG. 8 is an isometric front view of an example embodiment of a garment having at least one heating pad therein.

With reference now to the drawings, and in particular FIGS. 1 through 8 thereof, example of the instant deployable umbrella hood garment employing the principles and concepts of the present deployable umbrella hood garment and generally designated by the reference number 10 will be described.

Referring to FIGS. 1 through 8 a preferred embodiment of the deployable umbrella hood garment 10 is illustrated.

The present deployable umbrella hood garment 10 has been devised to enable deployment of a waterproof umbrella hood 20 from a pack member 22 disposed on a back of a garment 70. The umbrella hood 20 is devised to unfold from the pack member 22 and encapsulate the head and shoulders of a user, whereby rainfall is prevented from direct contact with said user's head and shoulders.

The present deployable umbrella hood garment 10, therefore, includes a pack member 22 wearable upon the torso of a user. The pack member 22 includes an upper end 24 proximal the neck of a user wearing the garment 70. The pack member 22 contains a waterproof umbrella hood 20, folded therein, which waterproof umbrella hood 20 is deployable therefrom, when desired.

The waterproof umbrella hood 20 is moveable between a folded position, stowed interior to the pack member 22, and a deployed position, unfurled to encapsulate the user's head and shoulders and prevent direct contact with rainfall.

The waterproof umbrella hood 20 is contemplated to include a support member 26 disposed within the umbrella hood 20, said support member 26 is disposed to support and secure the waterproof umbrella hood 20 in the deployed position. In an embodiment disclosed herein, the support member 26 is contemplated to include an inflatable base portion 28, an inflatable outer frame member 30, and an inflatable plurality of arcuate frame members 32, whereby the action of air pressurized into the support member 26 effects rapid deployment of the waterproof umbrella hood 20 from the folded position to the deployed position. Refolding of the waterproof umbrella hood 20 from the deployed position to the stowed position, is effective by action of at least one spring member 34 tensioned against the support member 26, when said support member 26 is inflated.

Mechanized means of deployment of the waterproof umbrella hood 20 is contemplated as part of this invention 10, whereby the waterproof umbrella hood 20 is unfoldable and foldable automatically. The mechanized means of deployment may include a tension spring, whereby the umbrella hood 20 is tensioned against a spring member when moved to the stowed position whereby the compressive force exerted by said spring member unfurls the umbrella hood 20, or the mechanized means may include a deployment wherein articulation of the support member 26 is effected by mechanical or motorized means.

Deployment of the waterproof umbrella hood 20 is effective when a button 36 is depressed. Depression of the button 36 activates a pump member 38 disposed in fluid communication with the support member 26 whereby air is pressurized into the support member 26 and the hood 20 is thereby caused to deploy from the pack member 22. Return of the umbrella hood 20 to the stowed position is effective when a second button 40 is depressed to deflate the support member 26 whereby action of the spring member refolds the hood member interior to the pack member 22. Deflation of the support member 26 may be effected by action of the pump member 38 operating in a reverse direction to force air out of the support member 26.

Inflation of the support member 26, and thus deployment of the umbrella hood 20, is effected sequentially whereby airflow through the support member is controlled by each of a plurality of apertures 40. The base portion 28 is disposed to inflate first. The outer frame member 30 is disposed arced over the base portion in position to line the hood 20 opening. Each of the plurality of arcuate frame members 32 is disposed between a top side of the base portion 28 and the outer frame member 30 and each of the plurality of apertures 40 is disposed to direct air pressurized into the base portion 28 into each of said plurality of arcuate frame members 32 and the outer frame member 30. Thus the base portion 28 pressurizes first, and then the outer frame member 30 and each of the plurality of arcuate frame members 32 is pressurized whereby the hood 20 deploys into the deployed position covering the head of a user wearing the pack member expediently butt sequentially.

Where motorized deployment is practiced, deployment and stowing of the umbrella hood may be effective by connection of a switch member (such as, for example, depression of a button) or by some other means of selectively connecting a circuit, whereby motorized articulation of the support member 30 is effective.

Deflation of the support member 26 is effected by action of the pump member 38 as well. At least one spring member 34 exerts force upon the support member 26 to fold the waterproof umbrella hood 20 back in to the folded position when the support member 26 is deflated.

An embodiment of the present deployable umbrella hood garment 10 includes a garment 70 to which the pack member 22 is attachable. A heating pad 72 may be disposed therein, whereby a user wearing the garment 70 may enjoy heat produced internal to the top 70. Said heat is contemplated to be generated from electrical energy applied through a bostrophedonic coil of wires, or by other means of reusable heat delivery. Any battery required may be ported in the pack member 22.

Thus the present deployable umbrella hood garment 10 includes a garment 70 wearable upon a torso of a user. The pack member 22 is dispositional upon a dorsal side of the garment 70, said pack member 22 disposed in a position to present an upper end 24 proximal a nape of a user's neck. A waterproof umbrella hood 20 is housed in the pack member 22, said waterproof umbrella hood 20 moveable between a folded position, disposed interior to the pack member 22, and a deployed position, deployed to cover and surround the head and shoulders of a user wearing the pack member 22.

The inflatable support member 26, disposed within the hood 20, is effective to deploy the hood 20 between the folded position and the deployed position. The support member 26 includes an inflatable base portion 28, having an upper surface 29 and a lower surface 31. An inflatable outer frame member 30 is disposed arcuately around the hood 20 opening to support the hood 20 when said outer frame member 30 is inflated.

An inflatable plurality of arcuate frame members 32 is disposed between the base portion 28 upper surface 29 and the outer frame member 30, each of said plurality of arcuate frame members 32 supportive of the hood 20 when the hood 20 is moved to the deployed position. A motorized pump member 38 is disposed in fluid communication with the support member 26, said pump member 38 actionable to pressurize air from the ambient surrounding and effect sequential inflation of the support member 26 as will be described subsequently.

A plurality of apertures 40 is disposed between the base portion 28 and the outer frame member 30 and each of the plurality of arcuate frame members 32. At least one spring member 34 is disposed interior to at least one of the plurality of arcuate frame members 32, said spring member 34 tensioned against the action of air pressure when the support member 26 is inflated. When the pump member 38 is activated, air is pressurized to fill the base portion 28, and air internal the support member 26 is regulated to pass through each of the plurality of apertures 40 once the base portion 28 of the support member 26 reaches a fill pressure whereby the outer frame member 30 and each of the plurality of arcuate frame members 32 is filled subsequent inflation of the base portion 28 to the fill pressure. Thus action of inflating the support member 26 is relayed sequentially to effect deployment of the hood 20 in due course.

Thus expedient deployment of the hood 20 from the pack member 22 is effected by inflation of the support member 26 in sequence of the base portion 28 followed by the outer frame member 30 and each of the plurality of arcuate frame members 32, said sequence effected by air pressure determining inflation of the support member 26 controlled through each of the plurality of apertures 40, whereby movement of the hood 20 to the deployed position is effective to overlie and surround the head and shoulders of a user wearing the garment 70 and deflation of the support member 26 subsequently effects return of the umbrella hood 20 to the folded position by recoiled action of the spring member 34 exerting mechanical force absent air pressure.

What is claimed is:

1. A deployable umbrella hood garment comprising:

a pack member wearable upon a dorsal side of a user, said pack member dispositional in a position with an upper end proximal a nape of a user's neck;

a waterproof umbrella hood housed in the pack member, said waterproof umbrella hood moveable between a folded position interior to the pack member and a deployed position disposed overlying a head of the wearer;

an inflatable support member disposed interior to the hood in operational communication with a pump member, said support member comprising:

an inflatable base portion having an upper surface and a lower surface;

an inflatable outer frame member disposed arcuately to support around the hood opening when said outer frame member is inflated; and an inflatable plurality of arcuate frame members disposed between the base portion upper surface and the outer frame member, each of said plurality of arcuate frame members supportive of the hood when the hood is moved to a deployed position;

wherein deployment of the hood effects opening of the pack member, actuation of the pump member to effect rapid, sequential inflation of the base portion, then each of the arcuate frame members and subsequently the outer frame member to effect sequential deployment of the hood member and maintain support of the hood in the deployed position overlying and surrounding the head whereby expedient covering during a inclement weather is enabled to keep a user's head and hair dry.

2. The deployable umbrella hood garment of claim 1 wherein depression of a button effects deployment of the umbrella hood.

3. The deployable umbrella hood pack of claim 1 wherein at least one of the plurality of arcuate frame members includes a spring member therein wherein inflation of the support member effects tensioning of the spring member whereby deflation of the support member enables recoil of the spring member to return the hood to the folded position.

4. The deployable umbrella hood garment of claim 1 wherein the garment further comprises a heating pad disposed throughout the garment whereby heat is producible from resistance of electrical energy applied through a bostrophedonic coil of wires disposed within said garment.

5. The deployable umbrella hood garment of claim 3 wherein deflation of the support member and return of the hood to the folded position is effective by depression of another button.

6. The deployable umbrella hood garment of claim 5 wherein the pack member is directly attachable to an item of clothing.

7. A deployable umbrella hood garment comprising:

a garment wearable upon a torso of a user;

a pack member dispositional upon a dorsal side of the garment, said pack member disposed in a position to present an upper end proximal a nape of a user's neck;

a waterproof umbrella hood housed in the pack member, said waterproof umbrella hood moveable between a folded position and a deployed position;

an inflatable support member disposed within the hood, said support member effective to deploy the hood between the folded position and the deployed position, said support member including:

an inflatable base portion having an upper surface and a lower surface;

an inflatable outer frame member disposed arcuately to support around the hood opening when said outer frame member is inflated; and an inflatable plurality of arcuate frame members disposed between the base portion upper surface and the outer frame member, each of said plurality of arcuate frame members supportive of the hood when the hood is moved to the deployed position;

a motorized pump member disposed in fluid communication with the support member, said pump member actionable to pressurize air from the ambient surrounding and effect sequential inflation of the support member;

wherein action effected to open the pack member effects movement of the hood to the deployed position overlying and surrounding the head of a user wearing the garment, whereby expedient covering during a precipitation event is enabled to keep a user's head and hair dry.

8. The deployable umbrella hood garment of claim 7 wherein sequential inflation of the support member effects inflation of the base portion before inflation of the outer frame member and each of the plurality of arcuate frame members, and the outer frame member and each of the plurality of arcuate frame members is filled in sequence to move the umbrella hood from the folded position to the deployed position in a series of discrete steps.

9. The deployable umbrella hood garment of claim 8 wherein sequential inflation of the support member is controlled effective through each of a plurality of apertures disposed between the base portion and the outer frame member and each of the plurality of arcuate frame members, whereby inflation of the base portion occurs first and subsequently inflation of the outer frame member and each of the plurality of arcuate frame members follows once pressure in the base portion reaches a maximum pressure.

10. The deployable umbrella hood garment of claim 9 wherein deployment of the hood and action of the pump member is effective by depression of a button.

11. The deployable umbrella hood garment of claim 10 wherein the pump member is disposed to effect deflation of the support member when selected by a user.

12. The deployable umbrella hood garment of claim 11 wherein the support member includes a spring member disposed interior to at least one of the plurality of arcuate members, whereby deflation of the support member releases pressure enabling retraction of the spring member to return the hood to the folded position interior to the pack member.

13. A deployable umbrella hood garment comprising:

a garment wearable upon a torso of a user;

a pack member dispositional upon a dorsal side of the garment, said pack member disposed in a position to present an upper end proximal a nape of a user's neck;

a waterproof umbrella hood housed in the pack member, said waterproof umbrella hood moveable between a folded position and a deployed position;

an inflatable support member disposed within the hood, said support member effective to deploy the hood between the folded position and the deployed position, said support member including:

an inflatable base portion having an upper surface and a lower surface;

an inflatable outer frame member disposed arcuately to support around the hood opening when said outer frame member is inflated;

an inflatable plurality of arcuate frame members disposed between the base portion upper surface and the outer frame member, each of said plurality of arcuate frame members supportive of the hood when the hood is moved to the deployed position;

a motorized pump member disposed in fluid communication with the support member, said pump member actionable to pressurize air from the ambient surrounding and effect sequential inflation of the support member;

a plurality of apertures disposed between the base portion and the outer frame member and each of the plurality of arcuate frame members; and at least one spring member disposed interior to at least one of the plurality of arcuate frame members, said spring member tensioned against the action of air pressure when the support member is inflated;

wherein expedient deployment of the hood from the pack member is effected by inflation of the support member in sequence of the base portion followed by the outer frame member and each of the plurality of arcuate frame members, said sequence effected by air pressure determining inflation of the support member controlled through each of the plurality of apertures, whereby movement of the hood to the deployed position is effective to overlie and surround the head and shoulders of a user wearing the garment and deflation of the support member subsequently effects return of the umbrella hood to the folded position by recoiled action of the spring member absent air pressure.

* * * * *